US008732872B2

(12) United States Patent
Grabow

(10) Patent No.: US 8,732,872 B2
(45) Date of Patent: May 27, 2014

(54) GABLE OVERHANG STRUCTURE

(75) Inventor: Jay E. Grabow, Gary, SD (US)

(73) Assignee: J-Gable, LLC, Watertown, SD (US)

( * ) Notice: Subject to any disclaimer, the term of this patent is extended or adjusted under 35 U.S.C. 154(b) by 0 days.

(21) Appl. No.: 13/604,264

(22) Filed: Sep. 5, 2012

(65) Prior Publication Data

US 2013/0055656 A1 Mar. 7, 2013

Related U.S. Application Data

(63) Continuation of application No. PCT/US2011/027176, filed on Mar. 4, 2011.

(60) Provisional application No. 61/373,528, filed on Aug. 13, 2010, provisional application No. 61/310,761, filed on Mar. 5, 2010.

(51) Int. Cl.

| | |
|---|---|
| ***E04D 13/00*** | (2006.01) |
| ***E04C 3/12*** | (2006.01) |
| ***E04B 1/26*** | (2006.01) |
| *E04B 7/24* | (2006.01) |

(52) U.S. Cl.

CPC ... *E04C 3/12* (2013.01); *E04B 1/26* (2013.01); *E04B 7/24* (2013.01)

USPC ..... 5/96; 52/94; 52/57

(58) Field of Classification Search

CPC ..... E04C 3/12; E04B 1/26; E04B 7/024

USPC ..... 52/57, 94, 95, 96

See application file for complete search history.

(56) References Cited

U.S. PATENT DOCUMENTS

| | | | | | |
|---|---|---|---|---|---|
| 3,293,808 | A | * | 12/1966 | Duncan | 52/92.2 |
| 4,122,647 | A | * | 10/1978 | Kovar | 52/695 |
| 4,179,857 | A | * | 12/1979 | Danford | 52/71 |
| 4,322,064 | A | * | 3/1982 | Jarvis | 269/43 |
| 4,461,128 | A | * | 7/1984 | Knoebl | 52/94 |
| 4,516,363 | A | * | 5/1985 | Beaulieu et al. | 52/92.1 |
| 4,704,829 | A | * | 11/1987 | Baumker, Jr. | 52/127.2 |
| 4,831,794 | A | * | 5/1989 | Perry | 52/90.2 |
| 4,878,323 | A | * | 11/1989 | Nelson | 52/92.2 |
| 4,947,612 | A | * | 8/1990 | Taylor et al. | 52/693 |
| 4,956,950 | A | * | 9/1990 | Hirose | 52/94 |
| 5,412,920 | A | | 5/1995 | Hess | |
| 5,540,015 | A | * | 7/1996 | Anthony | 52/95 |
| 5,577,354 | A | * | 11/1996 | Van Doren | 52/94 |

(Continued)

FOREIGN PATENT DOCUMENTS

| | | |
|---|---|---|
| JP | 01-192940 | 8/1989 |
| JP | 04-363449 | 12/1992 |
| WO | 96/35848 | 11/1996 |

*Primary Examiner* — William Gilbert
*Assistant Examiner* — Alp Akbasli
(74) *Attorney, Agent, or Firm* — Hamre, Schumann, Mueller & Larson, P.C.

(57) ABSTRACT

This disclosure relates to a gable overhang structure used in the building construction industry to support the gable end of the roof. The gable overhang structure allows for the pre-assembly of an overhang gable and the set back or elimination of the gable end rafter while providing the gable overhang with superior strength. The structure generally consists of a vertical member, at least one horizontal member, and fastening means. In addition, two or more structures are provided together to form a kit, wherein the vertical members are not of the same length.

9 Claims, 11 Drawing Sheets

(56) References Cited

U.S. PATENT DOCUMENTS

| | | | | |
|---|---|---|---|---|
| 5,718,086 | A * | 2/1998 | Dunn | 52/95 |
| 5,735,087 | A * | 4/1998 | Olden | 52/92.2 |
| 6,219,975 | B1 * | 4/2001 | Olden | 52/92.2 |
| 6,244,010 | B1 * | 6/2001 | Sluiter | 52/643 |
| 6,412,233 | B1 * | 7/2002 | Jones | 52/92.2 |
| 6,474,037 | B2 * | 11/2002 | Thompson | 52/713 |
| 6,672,014 | B1 * | 1/2004 | Jones | 52/92.2 |
| 6,754,999 | B1 * | 6/2004 | Urbanczyk | 52/272 |
| 6,988,346 | B2 * | 1/2006 | Shamroukh et al. | 52/693 |
| 6,993,882 | B2 * | 2/2006 | Crawford et al. | 52/696 |
| 7,377,048 | B2 * | 5/2008 | Koetter | 33/613 |
| 7,392,623 | B2 * | 7/2008 | Back et al. | 52/93.1 |
| 7,398,620 | B1 * | 7/2008 | Jones | 52/92.2 |
| 7,430,833 | B2 * | 10/2008 | Pulte | 52/57 |
| 7,617,612 | B2 * | 11/2009 | Brizendine | 33/613 |
| 7,797,905 | B1 * | 9/2010 | Smalley | 52/643 |
| 8,046,958 | B2 * | 11/2011 | Saurey | 52/96 |
| 8,091,291 | B2 * | 1/2012 | Ode | 52/93.1 |
| 8,156,692 | B2 * | 4/2012 | Saurey et al. | 52/96 |
| 8,161,709 | B2 * | 4/2012 | Saurey et al. | 52/745.05 |
| 2007/0271858 | A1 * | 11/2007 | Adams | 52/94 |
| 2007/0294959 | A1 * | 12/2007 | Saurey | 52/94 |
| 2007/0294960 | A1 * | 12/2007 | Saurey | 52/94 |
| 2009/0193726 | A1 * | 8/2009 | Saurey et al. | 52/74 |

* cited by examiner

GABLE OVERHANG STRUCTURE

FIELD

This disclosure relates to a gable overhang structure used in the building construction industry to support the gable end of the roof. The gable overhang structure allows for the pre-assembly of an overhang gable and set back or elimination of the gable end rafter while providing the gable overhang with superior strength. The structure generally consists of a vertical member, at least one horizontal member, and fastening means. In addition, two or more structures are provided together to form a kit, wherein the vertical members are not of the same length.

BACKGROUND

Gable roofs are one of the most common roof types. With a gable roof, there can be a gable overhang where the roof extends beyond the wall. In general, gable overhangs are twelve to 24 inches wide, but can be narrower or wider. As shown in FIGS. 1*a* and 1*b*, the gable overhang end 10 of the roof consists of a gable end rafter 12, ladder framing boards 14 and a fascia rafter 16.

The gable end rafter 12 is generally supplied as a pre-assembled component and is placed so that it is aligned with the outside wall of the structure. Ladder framing boards 14 are then connected to and/or supported by the top board 18 of the gable end rafter 12 in one of two common ways. The first way, as shown in FIG. 1*a*, is to drop the gable end rafter 12 so that it sits lower than the second rafter 15 by the width of the ladder framing boards 14 and lay the ladder framing boards 14 across the top board 18 of the gable end rafter 12. The second way, as shown in FIG. 1*b*, is to notch the top board 18 wherever a ladder framing board 14 will intersect the top board 18 and then insert the ladder framing board 14 within the notch.

The first ends 17 of the ladder framing boards 14 are then attached to the second rafter 15. The length of the ladder framing boards 14 is determined by the width of the overhang and extend this distance beyond the wall. Once the ladder framing boards 14 are in place and attached to the second rafter 15 and the top board 18, the fascia 16 is attached to the second ends 19 of the ladder framing boards 14.

The problem is that it is time consuming to construct the gable overhang, assembly must be performed on site and on the roof, and attachment of the fascia board can result in unsafe conditions for the workers. In addition, if not properly constructed, the overhang can weaken resulting in drooping of the overhang. There is a need for a system that is strong, efficient and simple.

SUMMARY

A gable overhang structure used in the building construction industry to support the gable end of the roof is described. The gable overhang structure allows for the pre-assembly of an overhang gable and the set back or elimination of the gable end rafter while providing the gable overhang with superior strength. The structure generally consists of a vertical member, at least one horizontal member, and fastening means. In addition, two or more structures are provided together to form a kit, since the vertical members are not of the same length depending on location of a structure from eave to ridge.

The kit is used to construct a gable structure consisting of a rafter, fascia boards, and the gable overhang structures. The rafter and fascia boards can be provided as part of the kit or can be provided separately. In addition, fastening means can be provided as part of the kit or can be provided separately. In addition, instructions by way of paperwork or electronic means, such as a DVD, can be provided as part of the kit or can be provided separately. In a preferred use, the assembly of the gable structure is completed on the ground or off-site and the structure is then raised and placed in the appropriate location on the building being constructed.

The gable overhang structure can be an "L" shape having a vertical member and a horizontal member. In this embodiment, the horizontal member is attached to the first rafter and the fascia, and the vertical member is attached to the first rafter and a ceiling stringer. The first structure is attached at the eave side and each successive structure is attached progressively closer to the roof ridge. As the structure progresses from the eave to the roof ridge, the vertical member increases in length.

The gable overhang structure can be an "h" shape having a vertical member, a first horizontal member and a second horizontal member where the vertical member is disposed between the first horizontal member and the second horizontal member. The length of the first horizontal member is longer than the length of the second horizontal member. In this embodiment, the first rafter is eliminated and the first horizontal member is attached to the second rafter and the fascia, and the second horizontal member is attached to a ceiling stringer. The first structure is attached at the eave side and each successive structure is attached progressively closer to the roof ridge. As the structure progresses from the eave to the roof ridge, the vertical member increases in length.

In one embodiment, a gable overhang structure consists of a vertical member and a horizontal member to form an "L" shape where the members are separate components that are fastened together.

In another embodiment, a gable overhang structure consists of a vertical member and a horizontal member to form an "L" shape where the members are cut as a unitary piece cut from a common material.

In another embodiment, a gable overhang structure consists of a vertical member and at least two horizontal members to form an "h" shape where the members are separate components that are fastened together.

In another embodiment, a gable overhang structure consists of a vertical member and at least two horizontal members to form an "h" shape where the members are cut as a unitary piece cut from a common material.

In another embodiment, a gable overhang structure consists of a "b" shaped structure where the structure is closed and is a unitary piece cut from a common material.

In another embodiment, a gable overhang structure consists of two vertical members and at least two horizontal members to form an open "b" shape where the members are separate components that are fastened together.

In another embodiment, a gable overhang structure consists of two vertical members and at least two horizontal members configured to form an open "b" shape, and at least two bracing members between the two vertical members so that the two bracing members form a "v" shape. The members are separate components that are fastened together.

DRAWINGS

FIG. 1*a* is an assembly drawing in perspective which illustrates a conventional gable overhang structure with a dropped gable end rafter.

FIG. 1*b* is an assembly drawing in perspective which illustrates a conventional gable overhang structure with a notched rafter top board.

Figure 5A:
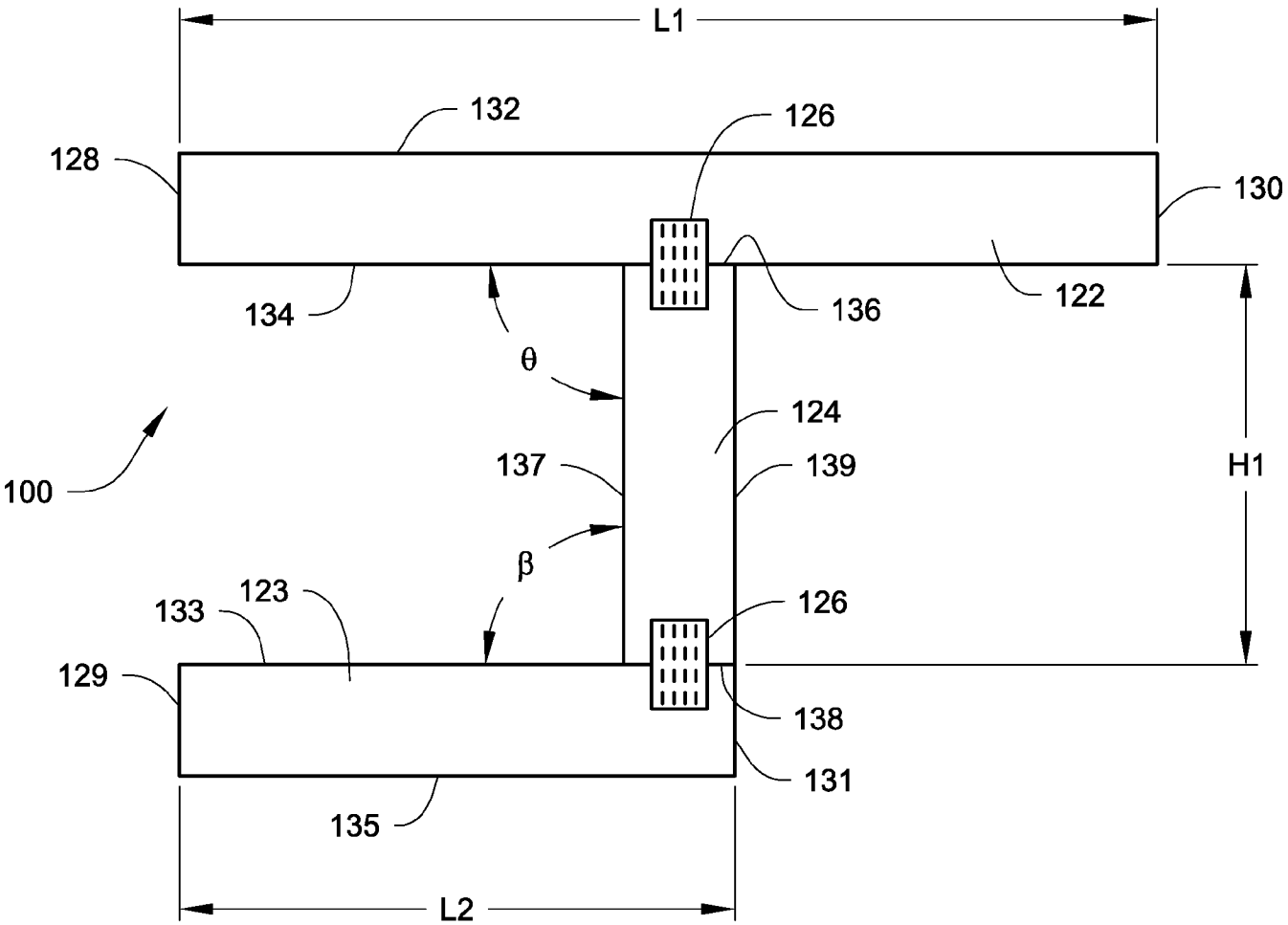

FIG. 5*a* is a side view which illustrates one embodiment of an "h" shaped gable overhang structure.

Figures 5B, 8:
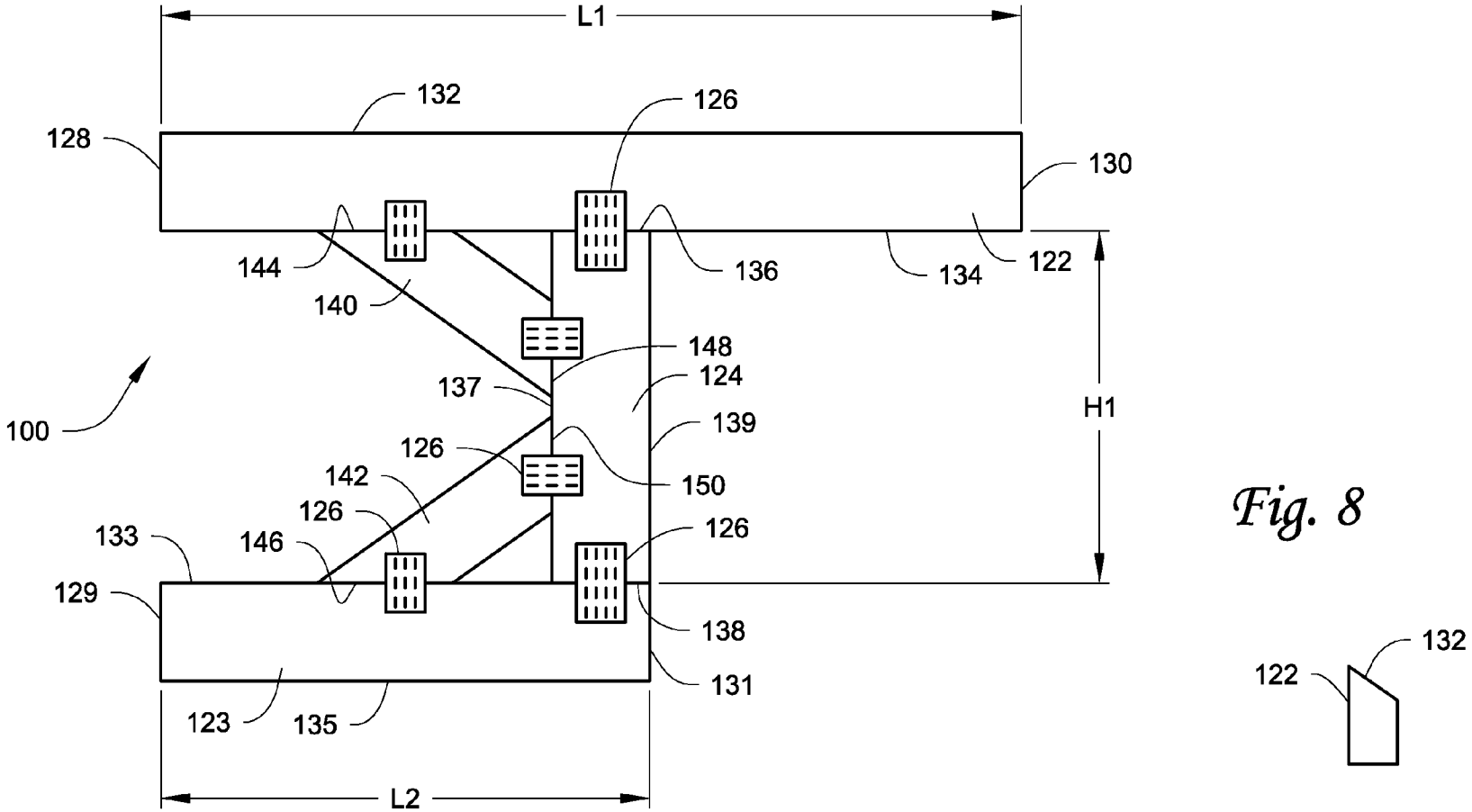

FIG. 5*b* is a side view which illustrates one embodiment of an "h" shaped gable overhang structure and includes two bracing members.

Figure 6A:
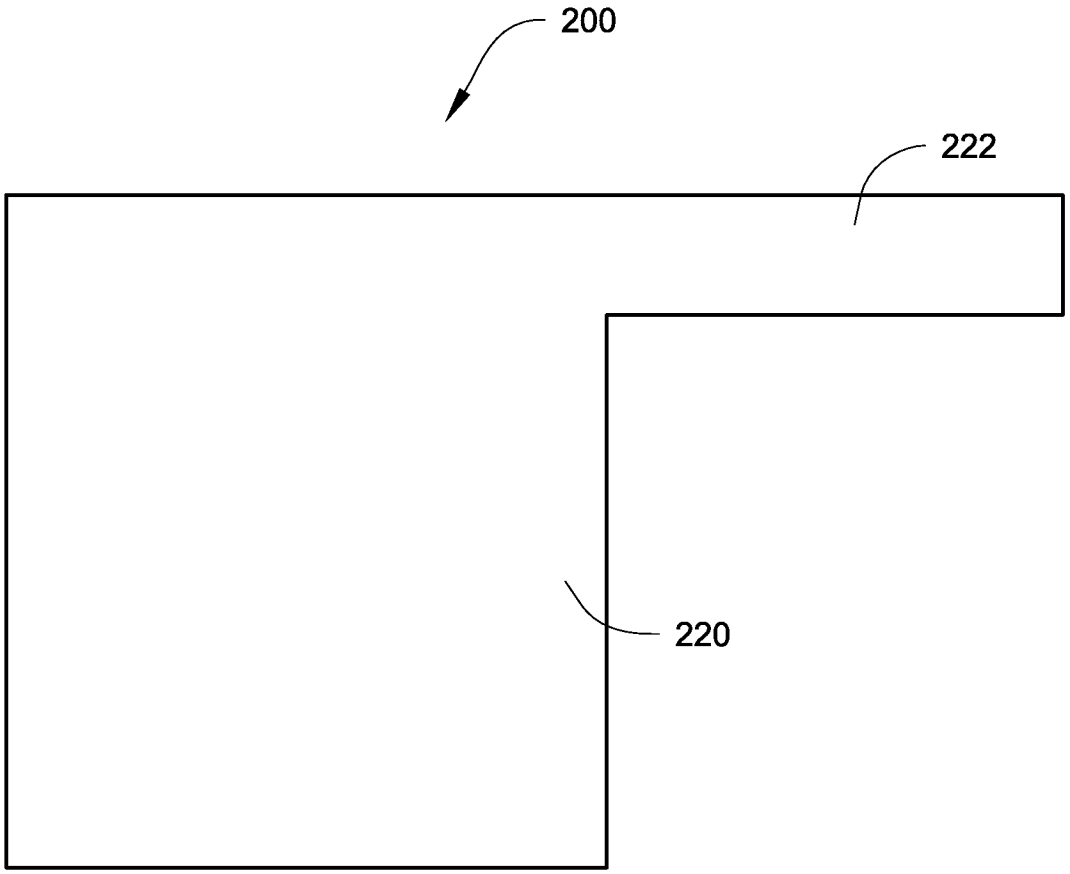

FIG. 6*a* is a side view which illustrates one embodiment of a "b" shaped gable overhang structure that is closed.

Figure 6B:
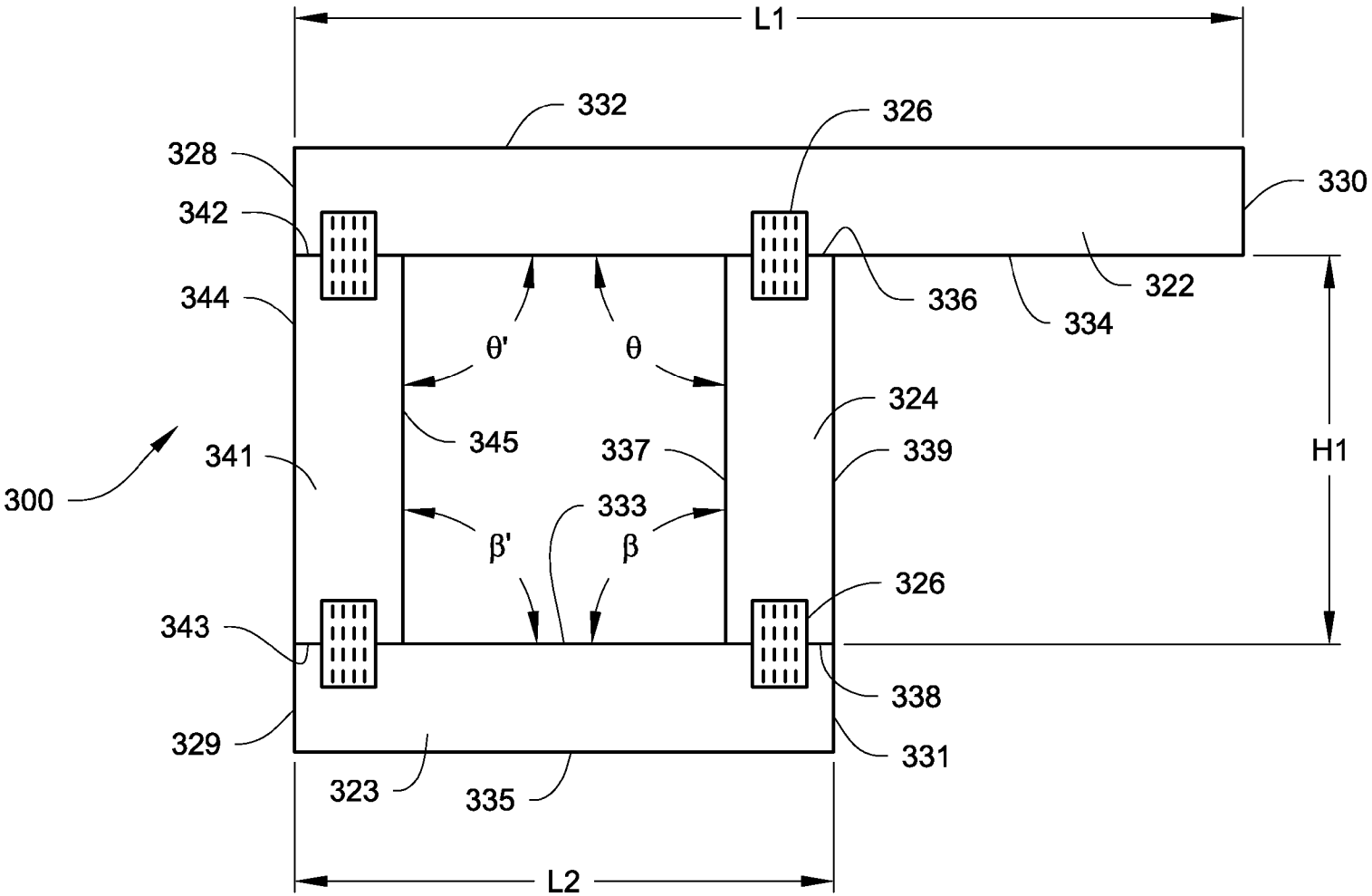

FIG. 6*b* is a side view which illustrates one embodiment of a "b" shaped gable overhang structure that is open.

Figure 6D:
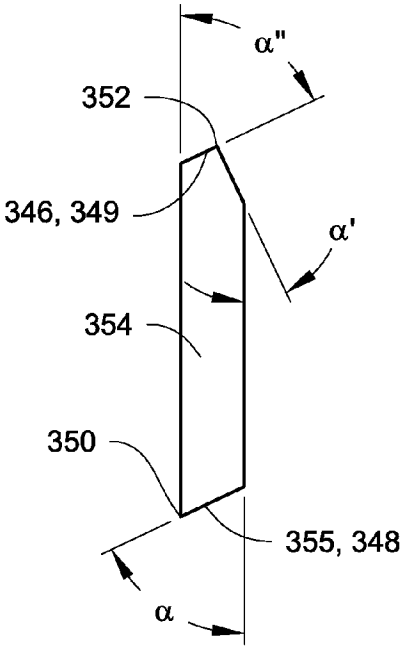
Figure 6C:
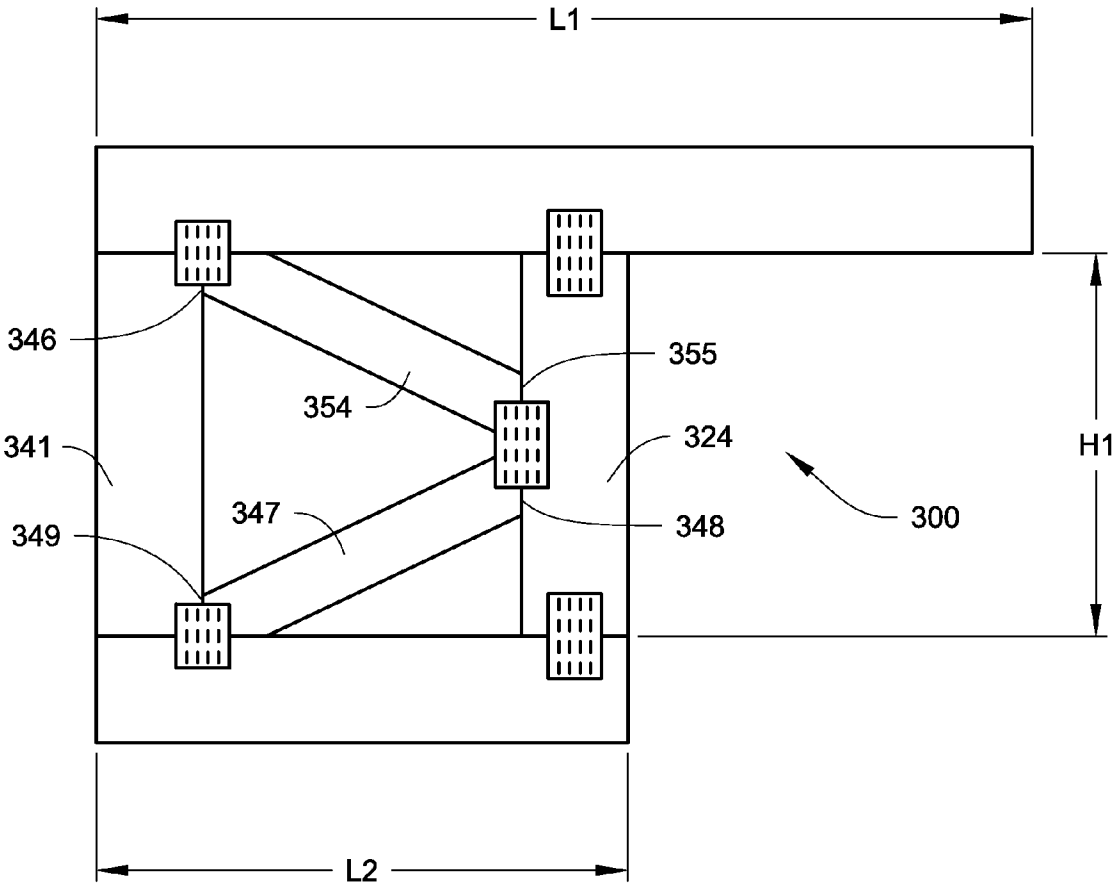

FIG. 6*c* is a side view which illustrates one embodiment of an open "b" shaped gable overhang structure that is open and includes two bracing members.

FIG. 6*d* illustrates a side view of a bracing member detailing the angle cuts on the top end and bottom end.

Figure 7A:
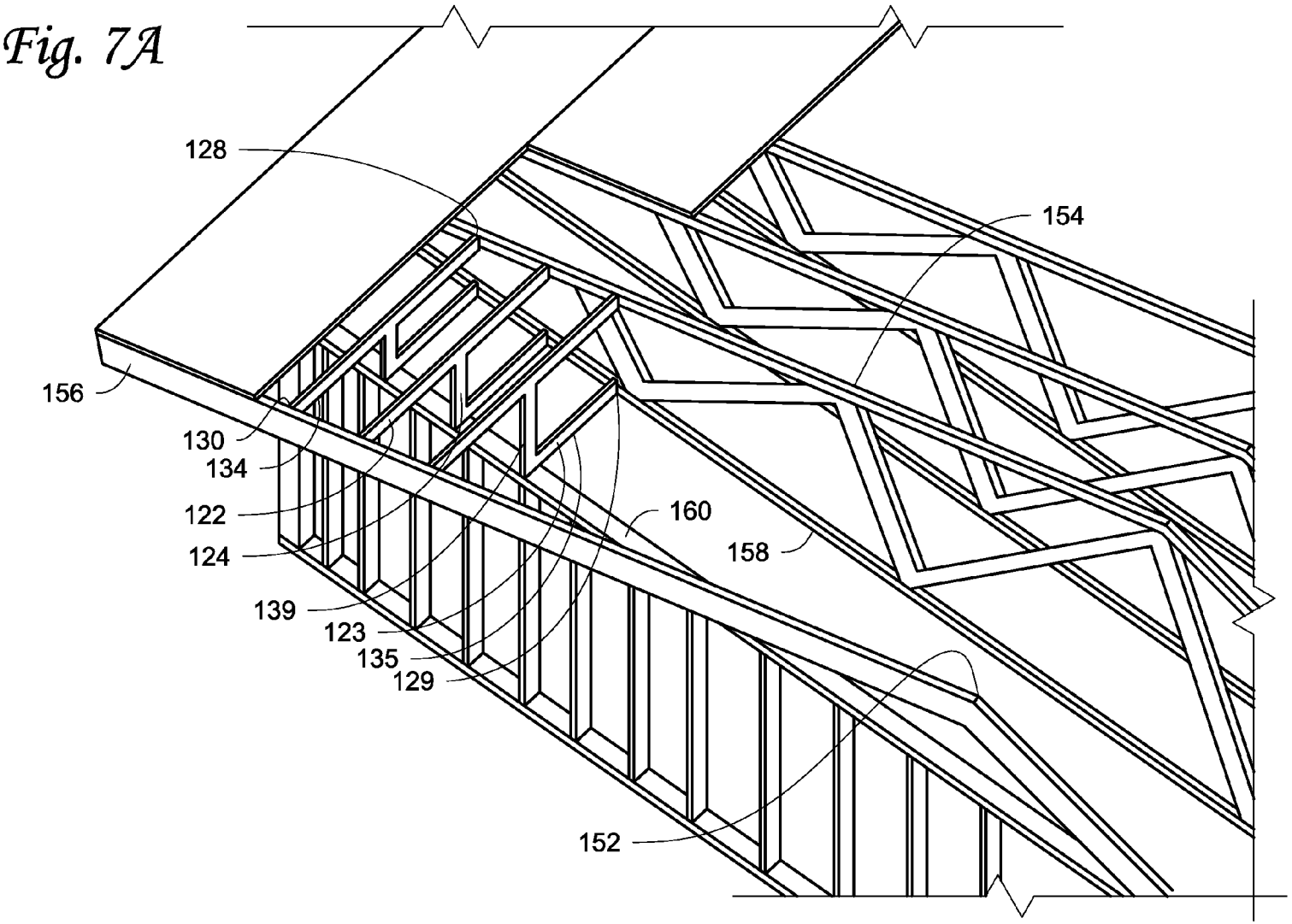

FIG. 7*a* is an assembly drawing in perspective which illustrates a schematic of an "h" shaped gable overhang structure construction.

Figure 7B:
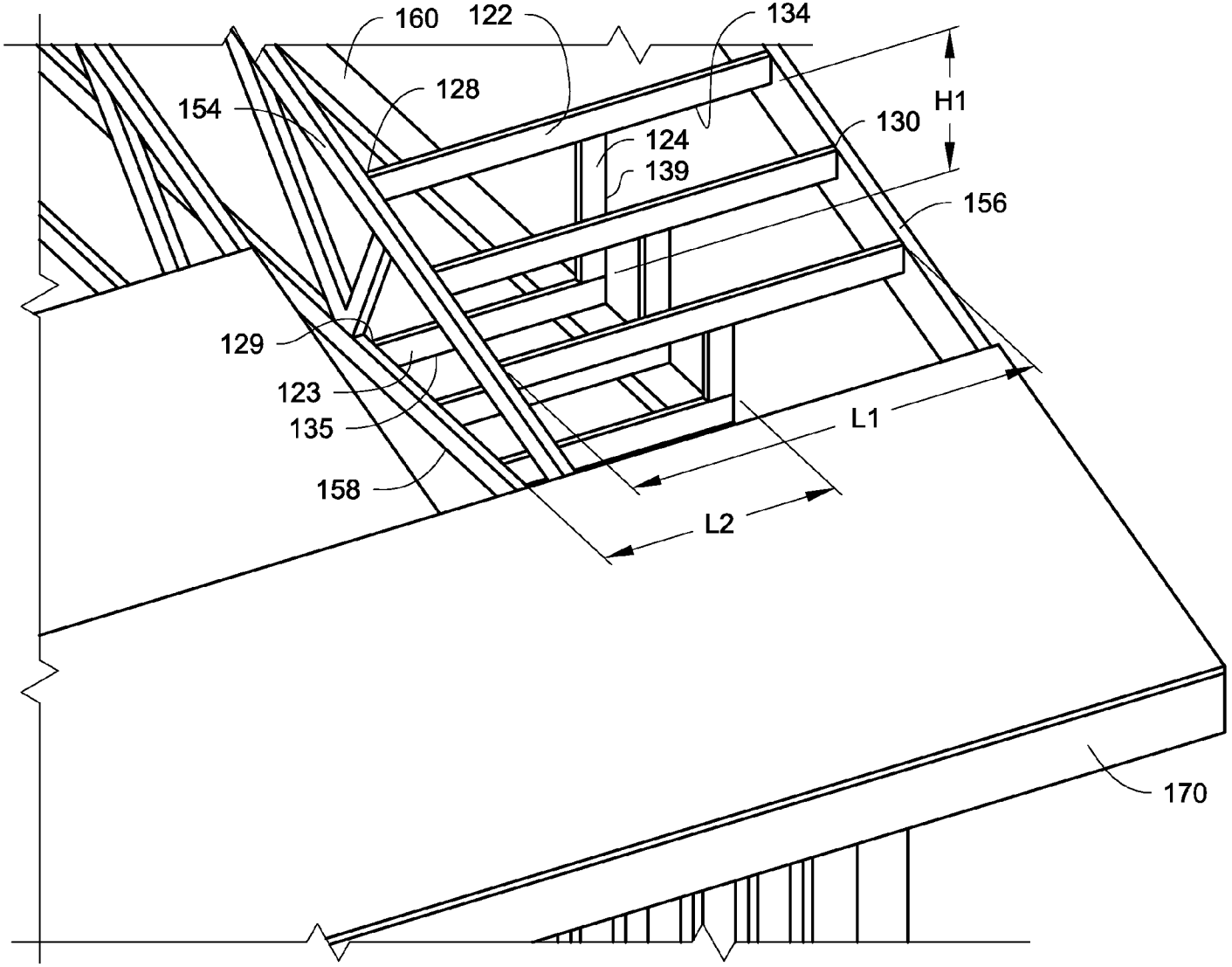

FIG. 7*b* is an assembly drawing in perspective which illustrates a schematic of an "h" shaped gable overhang structure construction.

FIG. 8 illustrates an end view of the first horizontal member detailing the top edge angle cut.

DETAILED DESCRIPTION

This disclosure relates to a gable overhang structure used in the building construction industry to support the gable end of the roof. The gable overhang structure allows for the pre-assembly of a structure for an overhang gable and the set back or elimination of the gable end rafter while providing the gable overhang with superior strength. The structure generally consists of a vertical member, at least one horizontal member, and fastening means. In addition, two or more structures are provided together to form a kit, wherein the vertical members are not of the same length. It should be noted that the structure can also be a single unitary body formed from a common material.

The kit is used to construct a gable structure consisting of a rafter, fascia boards, and the gable overhang structures. The rafter and fascia boards can be provided as part of the kit or can be provided separately. In addition, fastening means can be provided as part of the kit or can be provided separately. In addition, instructions by way of paperwork or electronic means, such as a DVD, can be provided as part of the kit or can be provided separately. In a preferred use, the assembly of the gable structure is completed on the ground or off-site and the structure is then raised and placed in the appropriate location on the building being constructed.

For clarity, throughout this disclosure the horizontal and vertical members will be considered to be dimensional lumber. It is noted that the horizontal and vertical members can be lumber of any dimension, but generally a 2" depth and a 4" width is preferred. The length of the dimensional lumber is dependent on the application. In addition, the horizontal and vertical members are not limited to dimensional lumber. They can be other wood types such as pressed wood, etc., metal, fiberglass or any material that provides the physical properties required to provide support and stability to the structure and the construction. The fastening means can be any type of fastening to include, but not limited to, metal plates, screws, nails, staples, mortise and tenon, glue, and dowels.

Figure 1A:
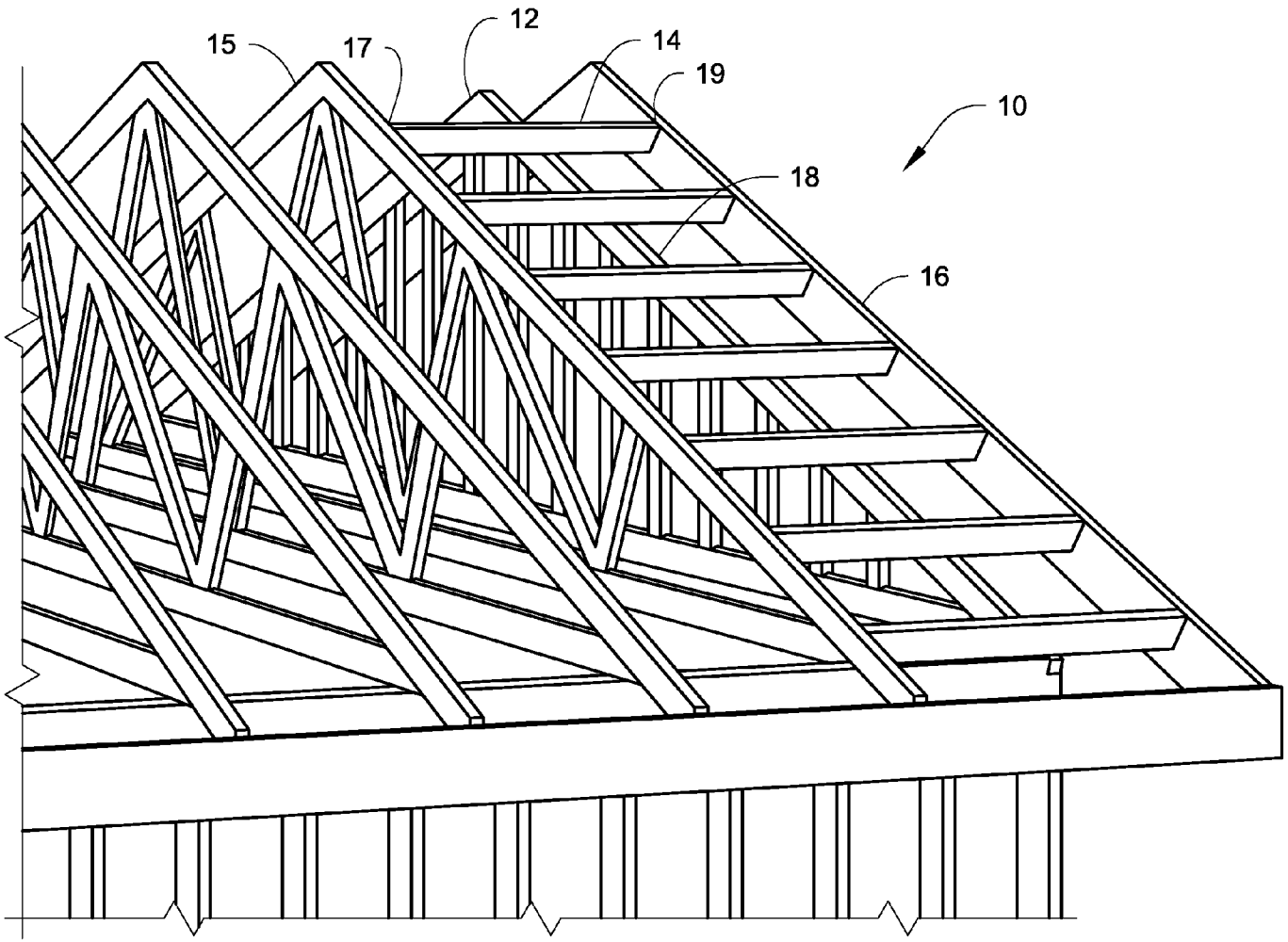
Fig. 1A (Prior Art)
Figure 1B:
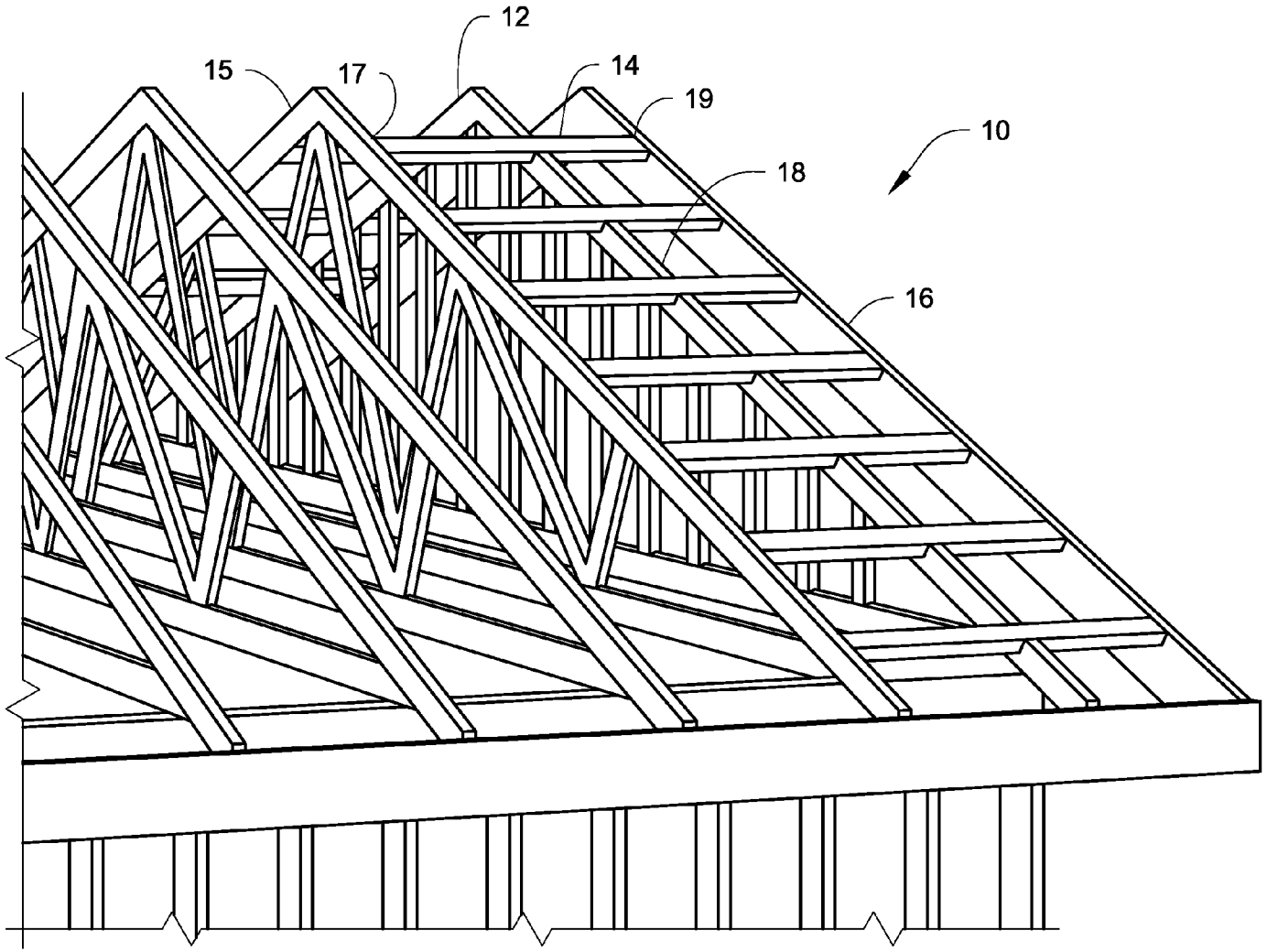
Fig. 1B (Prior Art)
Figure 2:
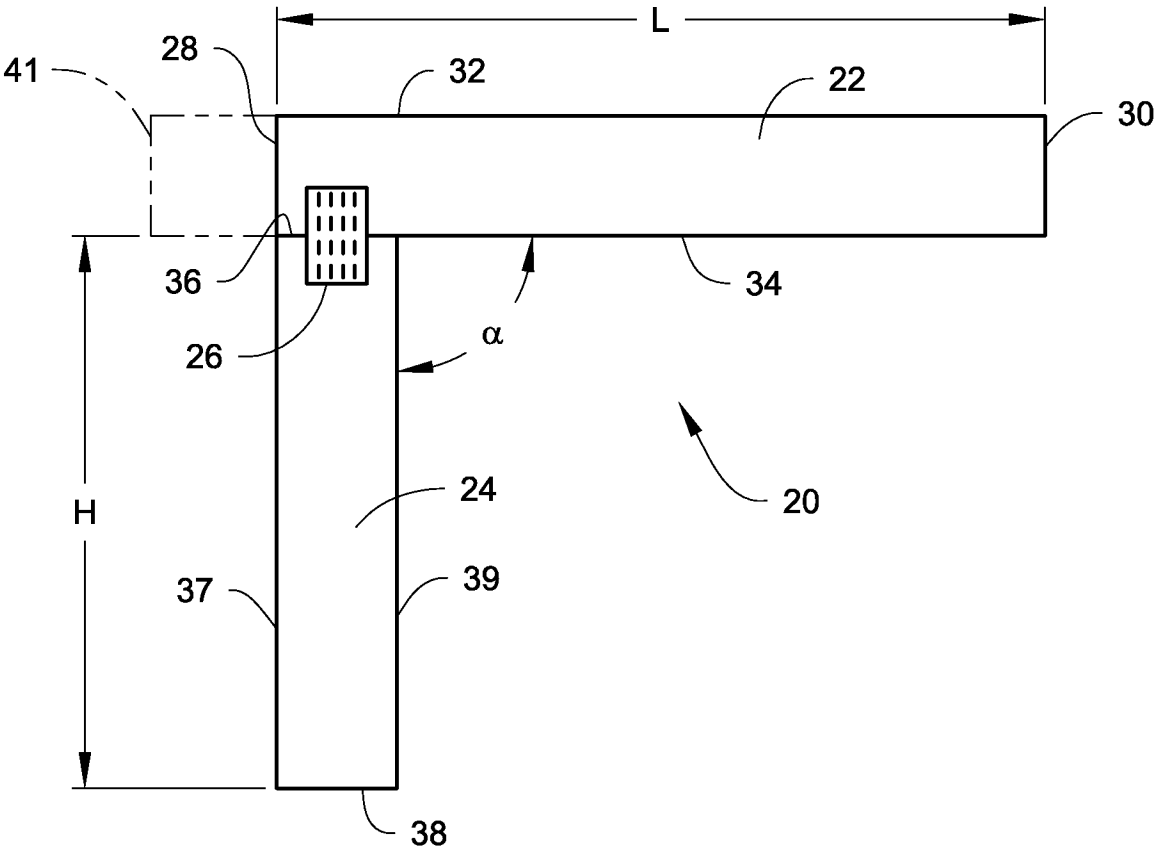
FIG. 2 is a side view which illustrates one embodiment of an "L" shaped gable overhang structure.

As shown in FIG. 2, an "L" shaped gable overhang structure 20 is provided. A horizontal member 22 is fastened, with a fastening means 26, to a vertical member 24 to form an "L" shape. The horizontal member 22 has a length L, a first end 28, a second end 30, a top edge 32 and a bottom edge 34. The vertical member 24 has a height H, a top end 36, a bottom end 38, and a left side edge 37 and a right side edge 39. The bottom edge 34 adjacent the first end 28, of the horizontal member 22, is contacted with the top end 36 of the vertical member 24 and a fastening means 26 is used to fasten the members 22, 24 together so that an angle $\alpha$ of 90° is formed. Alternatively the horizontal member 22 could extend beyond the vertical member as shown by broken line portion 41.

In another embodiment, a gable overhang structure 20 consists of a vertical member 24 and a horizontal member 22 where the members 22, 24 are cut from a common material as a unitary piece. For example, an "L" shaped gable overhang structure 20 is cut and removed from a sheet of 1¾" thick plywood in one unitary piece.

Figure 3:
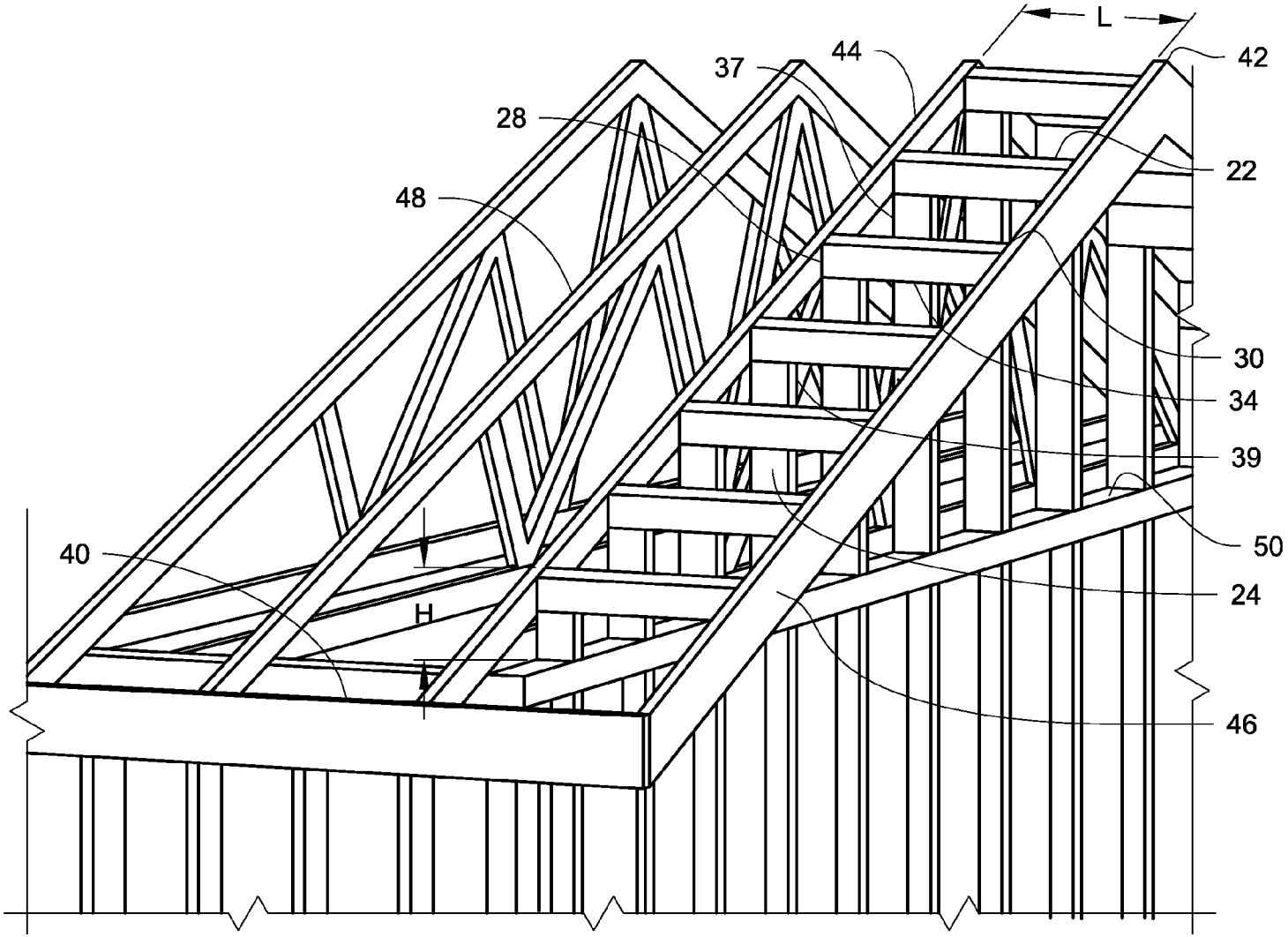
FIG. 3 is an assembly drawing in perspective which illustrates a schematic of an "L" shaped gable overhang structure construction.

The height H of the vertical member 24 is determined based on the pitch of the roof and the layout of the gable overhang structures 20. Gable overhang structures 20 can be provided in a kit where a plurality of structures 20 are provided to allow for construction from the roof eave 40 to the roof ridge 42, as illustrated in FIG. 3. Within the kit, the height H of the vertical members 24 vary for each of the plurality of structures 20 so that, when installed in the construction of the roof, the shortest height H vertical member 24 is located closest to the roof eave 40. Each successive vertical member 24, as the roof ridge 42 is approached, has a greater height H than the preceding vertical member 24.

The length L of the horizontal member 22 is determined based on the desired gable overhang width. In one embodiment, a plurality of gable overhang structures 20 are provided in a kit and the length L of each of the horizontal members 22 is the same. In another embodiment, a plurality of gable overhang structures 20 are provided in a kit and the length L of each of the horizontal members 22 can vary based on differences in the width of the gable overhang thereby providing the means to construct a butterfly lookout.

Figure 4:
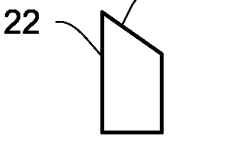
FIG. 4 illustrates an end view of the horizontal member detailing the top edge angle cut.

FIG. 4 provides an end view of the horizontal member 22 illustrating an embodiment where the horizontal member 22 has an angle cut on the top edge 32. The top edge 32 can be cut at an angle corresponding to the pitch of the roof. Cutting the top edge 32 will allow the roof sheeting to have full contact with the top edge 32 of the horizontal member 22 when the roof is constructed. In another embodiment, the top edge 32 is not cut and retains the corners of the dimensioned lumber.

As illustrated in FIG. 3, a first rafter 44 is set back from a top wall plate 50 and the horizontal member 22 first end 28 is fastened to the first rafter 44 and the second end 30 is fastened to a fascia 46. The vertical member 24 left side edge 37 is fastened to first rafter 44 and ceiling stringer 48. Fastening can be provided with, but is not limited to, the use of nails, staples, screws, metal plates, metal brackets, or glue. The vertical member 24 right side edge 39 is preferably set so that it is even with the outer edge of the outside lower wall and can be used to attach exterior sheeting or siding. The horizontal member 22 bottom edge 34 can be used for the attachment of soffit materials.

As shown in FIG. 5*a*, an "h" shaped gable overhang structure 100 is provided. A first horizontal member 122 and a second horizontal member 123 are fastened, each with a fastening means 126, to a vertical member 124 to form an "h" shape. The first horizontal member 122 has a length L1, a first end 128, a second end 130, a first top edge 132 and a first bottom edge 134. The second horizontal member 123 has a length L2, a third end 129, a fourth end 131, a second top edge 133, and a second bottom edge 135. The vertical member 124 has a height H1, a top end 136, a bottom end 138, a left side edge 137 and a right side edge 139.

The first bottom edge 134 of the first horizontal member 122 is contacted with the top end 136 of the vertical member 124 and a fastening means 126 is used to fasten the members 122, 124 together so that an angle θ of 90° is formed. The second top edge 133 adjacent the fourth end 141 of the second horizontal member 123 is contacted with the bottom end 138 of the vertical member 124 and a fastening means 126 is used to fasten the members 123, 124 together so that an angle β of 90° is formed. The first end 128 and the third end 129 are aligned on the same plane.

In the embodiment of FIG. 5*b*, the embodiment as shown in FIG. 5*a* is expanded upon to incorporate additional bracing. A first bracing member 140 and a second bracing member 142 are configured to be installed in the area between one of the first and second horizontal members 122, 123 and the vertical member 124. The first ends 144, 146 and the second ends 148, 150 of the first and second bracing members 140, 142 are cut to match the sides of the members to which they are fastened. It is understood that no bracing members may be used as in FIG. 5*a* or that one of the two bracing members 140, 142 may be used.

Assuming bracing member 140 is used, first end 144 is fastened to side 134 of horizontal member 122 and second end 148 is fastened to side 137 of vertical member 124 on the same plane. Assuming bracing member 142 is used, first end 146 is fastened to side 133 of horizontal member 123 and second end 150 is fastened to side 137 of vertical member 124 on the same plane. Fastening is accomplished by the use of a fastener as discussed above.

In another embodiment, a gable overhang structure 100 consists of a vertical member 124, a first horizontal member 122 and a second horizontal member 123 where the members 122, 123, 124 are cut from a common material as a unitary piece. For example, an "h" shaped gable overhang structure 100 is cut and removed from a sheet of 1¾" thick plywood in one unitary piece. In another embodiment, as shown in FIG. 6*a*, a gable overhang structure 200 is constructed where a rectangle 220 with a horizontal projection 222 is cut and removed from, for example, a sheet of 1¾" thick plywood in one unitary piece.

In the embodiment of FIG. 6*b*, an open "b" shaped gable overhang structure 300 is provided. A first horizontal member 322 and a second horizontal member 323 are fastened, each with a fastening means 326, to vertical members 324, 341 to form a "b" shape. The first horizontal member 322 has a length L1, a first end 328, a second end 330, a first top edge 332 and a first bottom edge 334. The second horizontal member 323 has a length L2, a third end 329, a fourth end 331, a second top edge 333, and a second bottom edge 335. The vertical members 324, 341 have a height H1, top ends 336, 342, bottom ends 338, 343, left side edges 337, 344 and a right side edge 339, 345.

The first bottom edge 334 of the first horizontal member 322 is contacted with the top end 336 of the first vertical member 324 and a fastening means 326 is used to fasten the members 322, 324 together so that an angle θ of 90° is formed. The second top edge 333 adjacent the fourth end 331 of the second horizontal member 323 is contacted with the bottom end 338 of the first vertical member 324 and a fastening means 326 is used to fasten the members 323, 324 together so that an angle β of 90° is formed.

The first bottom edge 334 adjacent the first end 328 of the first horizontal member 322 is contacted with the top end 342 of the second vertical member 341 and a fastening means 326 is used to fasten the members 322, 341 together so that an angle θ' of 90° is formed. The second top edge 333 adjacent the third end 329 of the second horizontal member 323 is contacted with the bottom end 343 of the second vertical member 341 and a fastening means 326 is used to fasten the members 323, 341 together so that an angle β' of 90° is formed. All members 322, 323, 324, 341 are aligned on the same plane.

In the embodiment of FIG. 6*c*, the embodiment as shown in FIG. 6*b* is expanded upon to incorporate additional bracing. A first bracing member 354 and a second bracing member 347, of generally equal dimensions, are configured to be installed in the area between the first vertical member 324 and the second vertical member 341. As detailed in FIG. 6*d*, the top end 345,348 of each bracing member 344, 347 is cut to form an angle α. The bottom end 346, 349 of each bracing member 344, 347 is cut to include two angles α', α" such that the bottom end forms a peak 352. It is to be understood that in another embodiment the bottom end 346, 349 of each bracing member 344, 347 can be cut to form a single angle.

The bracing members 344, 347 are fastened to the open "b" shaped gable overhang structure 300 so that the top ends 355, 348 of the bracing members 344, 347 are attached to the left side edge 337 of the first vertical member 324 on the same plane. It is preferred that the tips 350 of the top ends 355, 348 are adjacent to each other and that the tips 350 are positioned to be generally equidistant from the first vertical member 324 top end 336 and bottom end 338. Fastening is accomplished by the use of a fastening means 326.

The bracing members 344, 347 are further fastened to the open "b" shaped gable overhang structure 300, on the same plane, so that the peak 352 of the first bracing member 344 is adjacent the angle θ' of the structure 300 and the peak 352 of the second bracing member 347 is adjacent the angle β' of the structure 300. Fastening is accomplished by the use of a fastening means 326. The bracing members 344, 347 are dimensioned and configured so that they generally make a "v" shape when assembled.

It is to be understood that even though a generally "v" shaped bracing assembly has been described, other embodiments incorporating additional bracing members or different configurations of bracing members have been contemplated. For example, in other embodiments, one or more bracing members can be fastened between the bracing members 344, 347 or the tips 350 of the bracing members 344, 347 and the second vertical member 341. In another embodiment, bracing members in a generally "x" shape could be incorporated. In other embodiments, one or more bracing members could be installed parallel to the horizontal members 322, 323.

The height H1 of the vertical member 124 is determined based on the pitch of the roof and the layout of the gable overhang structures 100. Gable overhang structures 100 can be provided in a kit where a plurality of structures 100 are provided to allow for construction from the roof eave 170 to the roof ridge 152, as illustrated in FIGS. 7*a* and 7*b*. Within the kit, the height H1 of the vertical members 124 vary for each of the plurality of structures 100 so that, when installed in the construction of the roof, the shortest height H1 vertical member 124 is located closest to the roof eave 170. Each successive vertical member 124, as the roof ridge 152 is approached, has a greater height H1 than the preceding vertical member 124.

In the embodiment of FIGS. 7*a* and 7*b*, the first rafter 44, as shown in FIG. 3, is eliminated and the first horizontal member 122 is constructed so that its length L1 spans the distance between the second rafter 154 and the fascia 156. The top end 136 of the vertical member 124 is located at a position on the first bottom edge 134 of the first horizontal member 122 based on the desired gable overhang width and the distances to the second rafter 154 and the top wall plate 160. The second horizontal member 123 is constructed so that its length L2 spans the distance between the ceiling stringer 148 and the top wall plate 160.

In one embodiment, a plurality of gable overhang structures 100 are provided in a kit and the length L1 of each of the first horizontal members 122 is the same and the length L2 of each of the second horizontal members 123 is the same. In another embodiment, a plurality of gable overhang structures 100 are provided in a kit and the length L1 of each of the first horizontal members 122 varies based on differences in the width of the gable overhang thereby providing the means to construct a butterfly lookout, and the length L2 of each of the second horizontal members 123 is the same.

FIG. 8 provides an end view of the first horizontal member 122 illustrating an embodiment where the first horizontal member 122 has an angle cut on the top edge 132. The top edge 132 can be cut at an angle corresponding to the pitch of the roof. Cutting the top edge 132 will allow the roof sheeting to have full contact with the top edge 132 of the first horizontal member 122 when the roof is constructed. In another embodiment, the top edge 132 is not cut and retains the corners of the dimensioned lumber.

As illustrated in FIGS. 7*a* and 7*b*, the first rafter 44, as shown in FIG. 3, is eliminated and the first horizontal member 122 first end 128 is fastened to the second rafter 154 and the second end 130 is fastened to a fascia 156. The second horizontal member 123 third end 129 is fastened to the ceiling stringer 158 and the second bottom edge 135 adjacent the fourth end 131 will sit on the top wall plate 160 when the roof is constructed. Fastening can be provided with, but is not limited to, the use of nails, staples, screws, metal plates, metal brackets, or glue. The vertical member 124 right side edge 139 is preferably set so that it is even with the outer edge of the outside lower wall and exterior sheeting or siding can be attached to the right side edge 139. The vertical member 124 can be used to attach exterior sheeting or siding. The first horizontal members 122 first bottom edge 134 can be used for the attachment of soffit materials. The second horizontal member 123 second bottom edge 135 can be used for the attachment of ceiling plaster board or other ceiling materials.

The examples and embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A construction adapted to become part of a building having a gable roof, said building having a vertical stud wall with a horizontal top wall plate, said construction comprising:

a rafter adapted to have roof sheet material attached;

a fascia;

a plurality of structures for supporting an end of the gable roof, each of said structures having a first vertical member and a first horizontal member, said first horizontal member being attached to said rafter and said fascia, said first vertical member being attached to said first horizontal member such that said first vertical member at a lower end is configured to be in attaching connection with said top wall plate of said vertical stud wall, said first vertical members of said structures being successively longer to a peak of said rafter so that when said construction is installed as a part of said building, said first vertical members are successively longer from eave to roof ridge of said gable roof.

2. The construction in accordance with claim 1, wherein said plurality of structures each includes a second horizontal member attached to said first vertical member such that said first vertical member at a lower end is configured to be in attaching connection with said second horizontal member and said top wall plate of said vertical stud wall, said second horizontal member also being adapted for attachment to one of said ceiling stringers.

3. The construction in accordance with claim 2, wherein said first horizontal members have a first length for all said structures and said second horizontal members have a second length for all said structures, said first and second lengths being different.

4. The construction in accordance with claim 2, wherein at least some of said first horizontal members have differing lengths for said structures and said second horizontal members have same second lengths for said structures.

5. The construction in accordance with claim 2, wherein said plurality of structures each includes a second vertical member so that the second vertical member of a particular one of said structures is the same length as the first vertical member.

6. The construction in accordance with claim 2, wherein said plurality of structures each includes a bracing member between at least two members of the group comprising the first vertical member and the first and second horizontal members.

7. The construction in accordance with claim 6, wherein the group comprising the first and second vertical members and the first and second horizontal members for each of the plurality of structures is formed by a single unitary member.

8. The construction in accordance with claim 1, further comprising a metal plate fastening together the first vertical member and the first horizontal member.

9. A construction adapted to become part of a building having a gable roof, said building having a vertical stud wall with a horizontal top plate, said building further having ceiling stringers adapted to have ceiling sheet material attached, said construction comprising:

a rafter adapted to have roof sheet material attached;

a fascia;

a plurality of structures for supporting an end of the gable roof, each of said structures having a vertical member and first and second horizontal members comprising conventional two inch by four inch lumber, said first horizontal member being attached to said rafter and said fascia, said vertical member being attached to said first and second horizontal members such that said vertical member at a lower end is configured to be in attaching connection with said second horizontal member and said top wall plate of said vertical stud wall, said second horizontal member also being adapted for attachment to one of said ceiling stringers, said vertical members of said structures being successively longer to a peak of said rafter so that when said construction is installed as a part of said building, said vertical members are successively longer from eave to roof ridge of said gable roof, the vertical member and the first horizontal member of each of said structures and the vertical member and the second horizontal member of each of said structures being attached together with a fastening mechanism comprising a metal plate, wherein said construction has enhanced strength against wind incoming toward the end of said gable roof due at least to said structures being installed on the top plate of the vertical stud wall and perpendicular to the plane of said stud wall.

* * * * *